United States Patent [19]

DePenti et al.

[11] 4,128,178

[45] Dec. 5, 1978

[54] ROTARY TYPE RAILWAY CAR COUPLER

[75] Inventors: Kenneth L. DePenti, Mayfield Heights; William J. Metzger, Willoughby, both of Ohio

[73] Assignee: Midland-Ross Corporation, Cleveland, Ohio

[21] Appl. No.: 835,579

[22] Filed: Sep. 22, 1977

[51] Int. Cl.[2] ..... B61G 9/00

[52] U.S. Cl. ..... 213/62 A; 213/67 R

[58] Field of Search ..... 213/62 A, 75 B, 16–17, 213/50.5, 51, 61, 58, 59, 62 R, 97, 109, 138, 156, 166–170, 174, 219, 20, 21, 67 R, 67 A, 68, 69–72, 54, 56

[56] References Cited

U.S. PATENT DOCUMENTS

| | | | |
|---|---|---|---|
| 2,645,362 | 7/1953 | Spence | 213/109 X |
| 3,157,290 | 11/1964 | Kulieke | 213/62 A |
| 3,610,436 | 10/1971 | Wisler | 213/62 A X |

*Primary Examiner*—Trygve M. Blix
*Assistant Examiner*—Douglas C. Butler
*Attorney, Agent, or Firm*—Harlan E. Hummer

[57] ABSTRACT

An improved rotary-type F Car Coupler. The yoke of the coupler is provided with the side opening through which the pin for holding the shank of the coupler head to the yoke is removed. A plate is provided for covering the side opening and retaining the pin in position between the shank and yoke. The retainer plate is rotated into interlocking engagement with the yoke, and a cotter pin and stop are provided for restricting rotation of the plate to maintain it in interlock relation with the yoke.

12 Claims, 4 Drawing Figures

ROTARY TYPE RAILWAY CAR COUPLER

BACKGROUND OF THE INVENTION

The invention is suitable for use in rotary-type couplers, especially rotary-type F couplers utilized on gondola cars. A pin is used in such couplers to fasten the shank of the coupler head to the yoke of the coupler. The yoke is provided with an opening through which the pin is inserted into coupling engagement with the yoke and shank. It is possible for the pin to fall out under certain conditions. Therefore, it is desirable to cover the opening in the yoke to retain the pin in position.

Most cover plates are normally rigidly bolted over openings, thereby requiring an operator, to carry, among other things, a wrench for removing the nuts from the bolts to free a cover plate for removal from an opening. Many times, the nuts and bolts are rusted together making it virtually impossible to remove the cover plate. Thus a great deal of time can be lost in removing cover plates which are conventionally anchored by nuts and bolts. Moreover, it is not possible to use such an assembly, in this instance, because of the close tolerances between the shank of the coupler, the yoke, and the carsill or housing for the yoke. The invention is directed to the provision of a unique retainer plate which is easily removed for ready access to the opening which it covers. A few simple tools, normally carried by an operator are all that is required to lock and unlock the retainer plate in position on the yoke in blocking relation to the opening.

Briefly stated, the invention is in a rotary type coupler comprising a yoke with a longitudinal axis and a coupler head with an attached shank which is inserted longitudinally within the yoke. Means are provided for mounting the shank of the coupler head within the yoke for rotation about the longitudinal axis of the yoke, such means including a removable pin which holds the shank within the yoke. An opening, disposed in the yoke, is provided so that the pin can be removed from the shank and yoke. A pair of oppositely disposed arcuately shaped grooves are formed in the yoke adjacent the opening and a pair of abutments are disposed adjacent the pair of grooves. A plate for retaining the pin in position with the yoke and shank of the coupler head, is provided and has a pair of oppositely arcuately configured sides which are insertable in the grooves by rotation of the plate in one direction. A stop is carried by the retainer plate for engaging one of the pair of abutments to limit rotation of the cover plate in the one direction. Means, coacting with the cover plate, are provided for engaging the other of the pair of abutments to restrict rotation of the retainer plate in an opposite direction, when the stop engages the abutments, to firmly anchor the retainer plate in position.

DESCRIPTION OF THE DRAWING

The following description of the invention will be better understood by having reference to the annexed drawing, wherein.

DETAILED DESCRIPTION OF THE DRAWING

Figure 1:
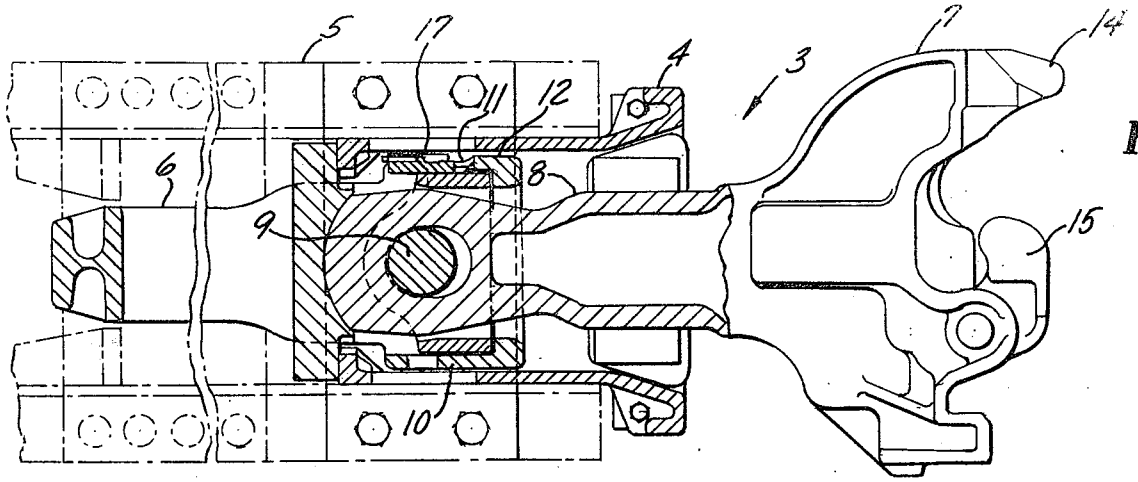
FIG. 1 is a plan view of a rotary-type coupler, made in accordance with the invention, with certain portions thereof shown in section.
Figure 2:
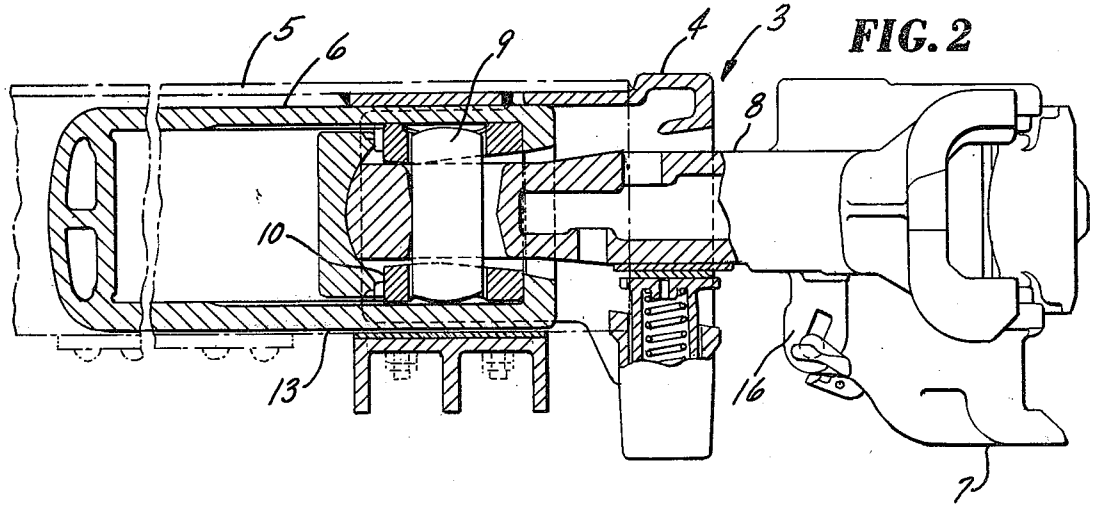
FIG. 2 is a side view of the coupler with certain portions shown in section.

With reference to FIGS. 1 and 2, there is shown a rotary-type F coupler 3 which comprises the essential components of a striker 4 and carsill 5 which are secured together in longitudinal alignment to the underside of a railroad car, a yoke 6 which is movable axially within the carsill 5 and extends longitudinally into the striker 4, a coupler head 7 and attached shank 8 which extends longitudinally into the striker 4 and is coupled by a yoke pin 9 to a mechanism 10 that is rotatable within the yoke 6.

Figure 4:
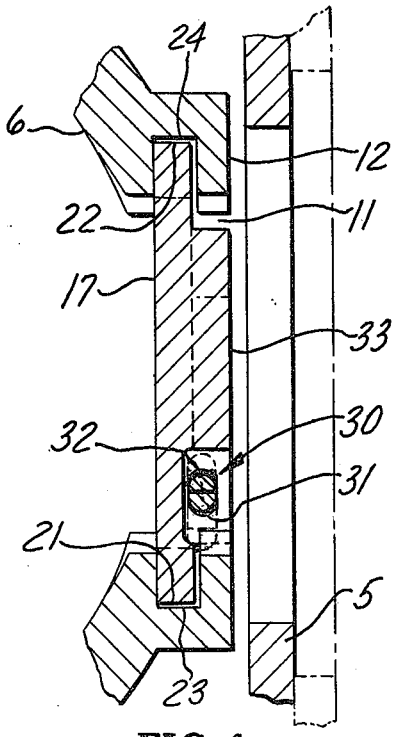
FIG. 4 is a section as viewed from the line 4 — 4 of FIG. 3. de

The yoke 6, as best seen in FIGS. 1 and 4, is provided with an opening 11 in the side 12 through which the pin 9 can be removed to disengage the shank 8 from the rotatable mechanism 10 of the yoke 6. The opening 11, in this instance, is disposed in the vertically disposed side 12 of the yoke 6, as distinguished from being in the bottom 13 of the yoke 6 (FIG. 2), as in normally the case when the car coupler 3 is in a normal position on a horizontally disposed railway car.

The coupler head 7 comprises the essential components of a guard arm 14, a knuckle 15 which is rotatably mounted on the coupler head 7, and a locking mechanism 16 for maintaining the knuckle 15 in a closed position in interlocked relation with a knuckle of an opposing coupler.

Figure 3:
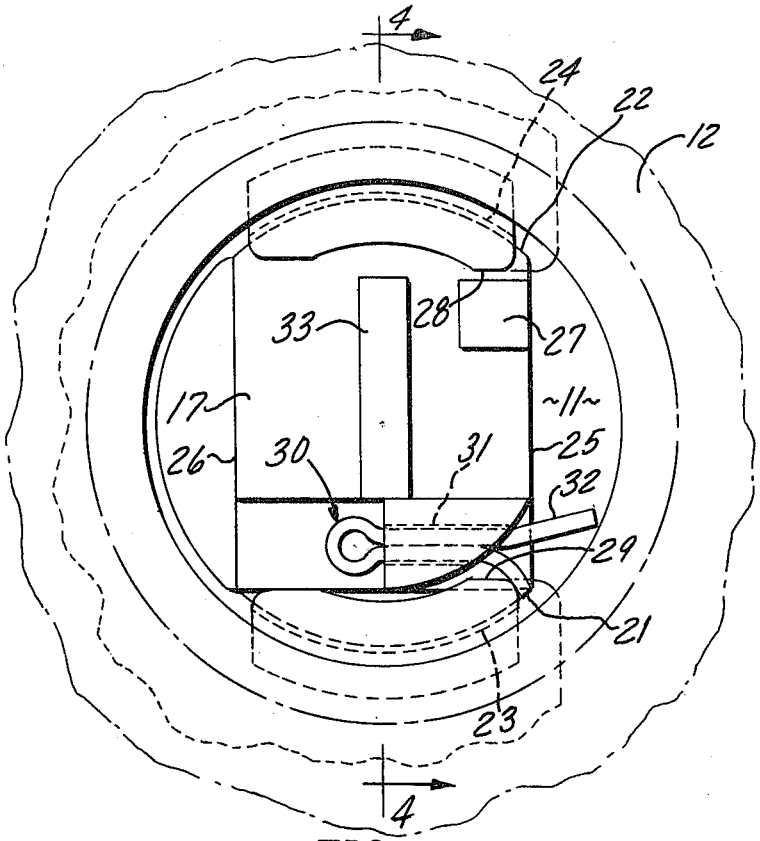
FIG. 3 is a plan view of the retainer plate in the opening of the yoke with adjacent portions of the coupler shown in dotted line.

With reference to FIGS. 1, 3, and 4, there is shown a retainer plate 17 which covers the opening 11 in the yoke 6 and prevents accidental or deliberate removal of the pin 9 through the opening 11. The retainer plate 17 has a pair of opposing, arcuately configured sides 21, 22 which are insertable in a pair of matingly shaped grooves 23, 24 that are formed in the yoke 6 adjacent the opening 11, by rotation of the retainer plate 17. The retainer plate 17 also has a pair of parallel sides 25, 26 intermediate the curved sides 21, 22.

A stop 27 (FIG. 3), in the form of a rectangular projection extending from the plane of the retainer plate 17, is carried by the retainer plate 17 for engaging one of a pair of abutments 28, 29, which are rigidly secured adjacent the pair of grooves 23, 24. The stop 27 engages the first to encounter abutment 28, as the retainer plate 17 is rotated into position, to restrict rotation of the retainer plate 17 in one direction. Continued rotation of the retainer plate 17 in said direction would cause the curved sides 21, 22 to become disengaged from the grooves 23, 24.

Means, generally indicated at 30, are provided for engaging the other abutment 9 to restrict rotation of the retainer plate 17 in the opposite direction, when the stop 27 engages the first abutment 28, to firmly lock the retainer plate 17 in position and prevent the pin 9 from accidentally falling through the opening 11 in the yoke 6. The means 30 comprises a pin hole 31 which is formed in the retainer plate 17 opposite the stop 27. The pin hole 31 has a longitudinal axis which parallels the plane of the retainer plate 17. A cotter pin 32 is insertable in the pin hole 31 and bent, as shown in FIG. 3, to engage the second to encounter abutment 29 when the stop 27 strikes the first to encounter abutment 28.

A handhold 33, in the form of a rib projecting from the plane of the retainer plate 17, is provided for grasping the retainer plate 17 and rotating it into an out of engagement with the grooves 23, 24. Thus, an operator need only be concerned about the cotter pin 32 in the positioning and removal of the retainer plate 17. In practice, the coupler shank 8 is inserted longitudinally into the rotating mechanism 10 of the yoke 6. The coupler head 7 and shank 8 are then rotated to where the pin holes of the shank 8 and rotating mechanism 10 of the yoke 6, are aligned with the opening 11. The pin 9 is next inserted to couple the shank 8 and rotating mechanism 10 together. The retainer plate 17 is then rotatably mounted on the yoke 6 until the stop 27 strikes the first to encounter abutment 28. The cotter pin 30 is then inserted in the pin hole 30 and bent into engagement with the second to encounter abutment 29, as best seen in FIG. 3. The retainer plate 17 (FIG. 4) is sufficiently thin that it will not interfere with rotation of the shank 8 and longitudinal movement of the yoke 6.

Thus, there has been provided, an improved rotary-type coupler having a retainer plate which is readily accessible and easily disengaged to permit quick removal of the pin which holds the coupler head and shank to the rotating mechanism of the yoke, whereby, a worn coupler head can be expeditiously replaced with a new one.

What is claimed is:

1. A rotary-type coupler, comprising;

(a) a yoke with a longitudinal axis;

(b) a coupler head with a shank which is insertable longitudinally within the yoke;

(c) means for mounting the shank of the coupler head within the yoke for rotation about the longitudinal axis of the yoke, said means including a removable pin for holding the shank within the yoke;

(d) an opening disposed in the yoke and through which the pin is removed from the shank and yoke;

(e) a pair of opposing arcuately shaped grooves disposed in the yoke adjacent the opening;

(f) a pair of abutments disposed adjacent the pair of grooves;

(g) a retainer plate having opposing, arcuately configured sides which are insertable in the grooves by rotation of the plate;

(h) a stop carried by the retainer plate for engaging one of the pair of abutments to restrict rotation of the retainer plate in one direction; and (i) means coacting with the retainer plate for engaging the other of the pair of abutments to restrict rotation of the retainer plate in a direction which is opposite said one direction, when the stop engages said one of the pair of abutments.

2. The coupler of claim 1, wherein the retainer plate has a pair of parallel sides intermediate the opposing, arcuately configured sides thereof.

3. The coupler of claim 2, wherein said means coacting with the retainer plate for engaging the other of the pair of abutments, includes a cotter pin which is insertable in a pin hole formed in the retainer plate, the pin hole having a longitudinal axis which is parallel to the plane of the retainer plate.

4. The coupler of claim 3 wherein the pin hole and stop are disposed adjacent the opposing, arcuately configured sides of the retainer plate.

5. The coupler of claim 4, which includes a handhold project-from the plane of the retainer plate by which the retainer plate is grasped and rotated into and out of the pair of grooves.

6. The coupler of claim 5, wherein the grooves and the curved sides of the retainer plate are matingly configured.

7. The coupler of claim 6, which includes a knuckle carried by the coupler head, and means for mounting the knuckle for rotation about an axis which is parallel to the plane in which the pin, holding the shank of the coupler within the yoke, rotates.

8. The coupler of claim 1, wherein the means for engaging the other of the pair of abutments includes deformable means which are bendable from a first position, where said deformable means will not engage said other abutment upon rotation of the retainer plate, to another position where said deformable means will engage said other abutment upon rotation of the retainer plate.

9. The coupler of claim 8, wherein the deformable means includes a conventional cotter pin.

10. A rotary-type coupler, comprising;

(a) a yoke with a longitudinal axis;

(b) a coupler head with a shank which is insertable within the yoke;

(c) means for mounting the shank of the coupler head within the yoke for rotation about the longitudinal axis of the yoke, said means including a removable pin for holding the shank within the yoke;

(d) an opening disposed in the yoke and through which the pin is removed from the shank and yoke;

(e) a pair of opposing arcuately shaped grooves disposed in the yoke adjacent the opening;

(f) a retainer plate having opposing, arcuately configured sides which are insertable in the grooves by rotation of the plate; and (g) bendable means coacting between the retainer plate and yoke for restricting rotation of the retainer plate when the curved sides thereof are in the grooves adjacent the opening.

11. The rotary-type coupler of claim 10, wherein the bendable means (g) includes a deformable cotter pin.

12. The rotary-type coupler of claim 11, which includes a pair of abutments disposed adjacent the pair of grooves, a stop carried by the retainer plate for engaging one of the pair of abutments to restrict rotation of the retainer plate in one direction, and means for positioning the cotter pin adjacent the other of the pair of abutments so that the cotter pin can be bent to engage the other abutment and restrict rotation of the retainer plate in a direction which is opposite the direction in which the abutment engaging stop restricts movement.

* * * * *